US008441399B2

(12) United States Patent
Wu et al.

(10) Patent No.: US 8,441,399 B2
(45) Date of Patent: May 14, 2013

(54) THREE-DIMENSIONAL SLOT ANTENNA

(75) Inventors: Chao-Hsu Wu, Luzhu Township, Taoyuan County (TW); Yuan-Chang Chao, Dayuan Township, Taoyuan County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 310 days.

(21) Appl. No.: 13/008,039

(22) Filed: Jan. 18, 2011

(65) Prior Publication Data

US 2012/0050134 A1 Mar. 1, 2012

(30) Foreign Application Priority Data

Aug. 26, 2010 (TW) ..... 99128634 A

(51) Int. Cl.
*H01Q 1/38* (2006.01)

(52) U.S. Cl.
USPC ..... 343/700 MS; 343/767; 343/702

(58) Field of Classification Search ..... None
See application file for complete search history.

(56) References Cited

U.S. PATENT DOCUMENTS

| | | | | |
|---|---|---|---|---|
| 7,564,411 | B2 * | 7/2009 | Piisila et al. | 343/702 |
| 8,299,972 | B2 * | 10/2012 | Lai | 343/702 |
| 2009/0153423 | A1 * | 6/2009 | Dinallo et al. | 343/767 |
| 2010/0013713 | A1 * | 1/2010 | Peng et al. | 343/700 MS |
| 2010/0289712 | A1 * | 11/2010 | Zheng et al. | 343/767 |

* cited by examiner

*Primary Examiner* — Trinh Dinh
(74) *Attorney, Agent, or Firm* — Hammer & Associates, P.C.

(57) ABSTRACT

A three-dimensional slot antenna includes a loop conductor, a first conductor arm, a second conductor arm, and a third conductor arm. The first radiator section, the second radiator section and the third radiator section are disposed on a same plane. The second radiator section cooperates with the first and third radiator sections to form a first slot segment. The first radiator section further cooperates with the third radiator section to form a second slot segment. The first and second slot segments form a substantially T-shaped slot.

12 Claims, 13 Drawing Sheets

THREE-DIMENSIONAL SLOT ANTENNA

CROSS-REFERENCE TO RELATED APPLICATION

This application claims priority of Taiwanese Application No. 099128634, filed on Aug. 26, 2010.

BACKGROUND OF THE INVENTION

1. Field of the Invention

The present invention relates to an antenna, more particularly to a miniaturized multi-band three-dimensional slot antenna.

2. Description of the Related Art

Conventional multi-band antennas operable in Wireless Local Area Network (WLAN) and World Interoperability for Microwave Access (WiMAX) frequency bands are mostly based on a Planar Inverted-F Antenna (PIFA) design, and may employ parasite elements for enhancing antenna coupling so as to achieve effects of multi-band or broadband operation.

However, the conventional multi-band antennas applied in portable electronic devices, such as notebook computers, have disadvantages of dimensional constraints and relatively inferior performance in terms of efficiency and gain.

SUMMARY OF THE INVENTION

Therefore, an object of the present invention is to provide a multi-band three-dimensional slot antenna that can alleviate the above disadvantages of the prior art.

Accordingly, the three-dimensional slot antenna of this invention includes a loop conductor, a first conductor arm, a second conductor arm, and a third conductor arm.

The loop conductor has a first side, a second side opposite to the first side, and a third side extending between the first and second sides.

The first conductor arm includes a first radiator section and a first connecting section interconnecting the first radiator section and the first side of the loop conductor.

The second conductor arm includes a second radiator section connected to the third side of the loop conductor.

The third conductor arm includes a third radiator section and a third connecting section interconnecting the third radiator section and the second side of the loop conductor.

The first radiator section, the second radiator section and the third radiator section are disposed on a same plane. The second radiator section cooperates with the first and third radiator sections to form a first slot segment. The first radiator section further cooperates with the third radiator section to form a second slot segment. The first and second slot segments form a substantially T-shaped slot.

Preferably, the loop conductor, the first conductor arm, the second conductor arm, and the third conductor arm are formed integrally. The three-dimensional slot antenna further includes a transmission line having a signal terminal and a grounding terminal. The loop conductor further includes a feed-in part connected to the signal terminal, and a grounding part connected to the grounding terminal.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
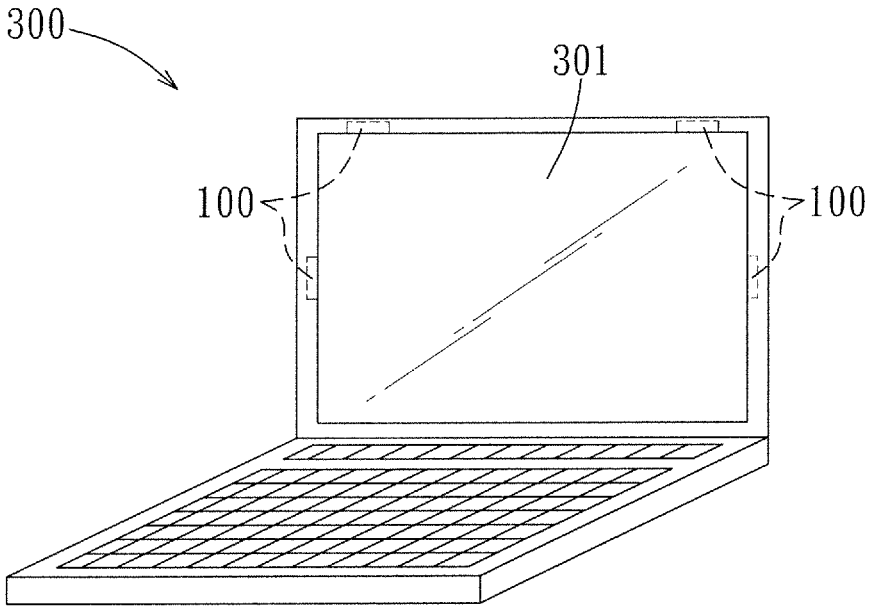
FIG. 1 is a perspective view, illustrating a preferred embodiment of a three-dimensional slot antenna of the present invention disposed in a portable electronic device.

Referring to FIG. 1, a preferred embodiment of a three-dimensional slot antenna 100 of the present invention is for disposing in portable electronic devices, such as a notebook computer 300. There may be a plurality of the three-dimensional slot antennas 100, which are disposed at a periphery of a display screen 301 of the notebook computer 300.

Figure 2:
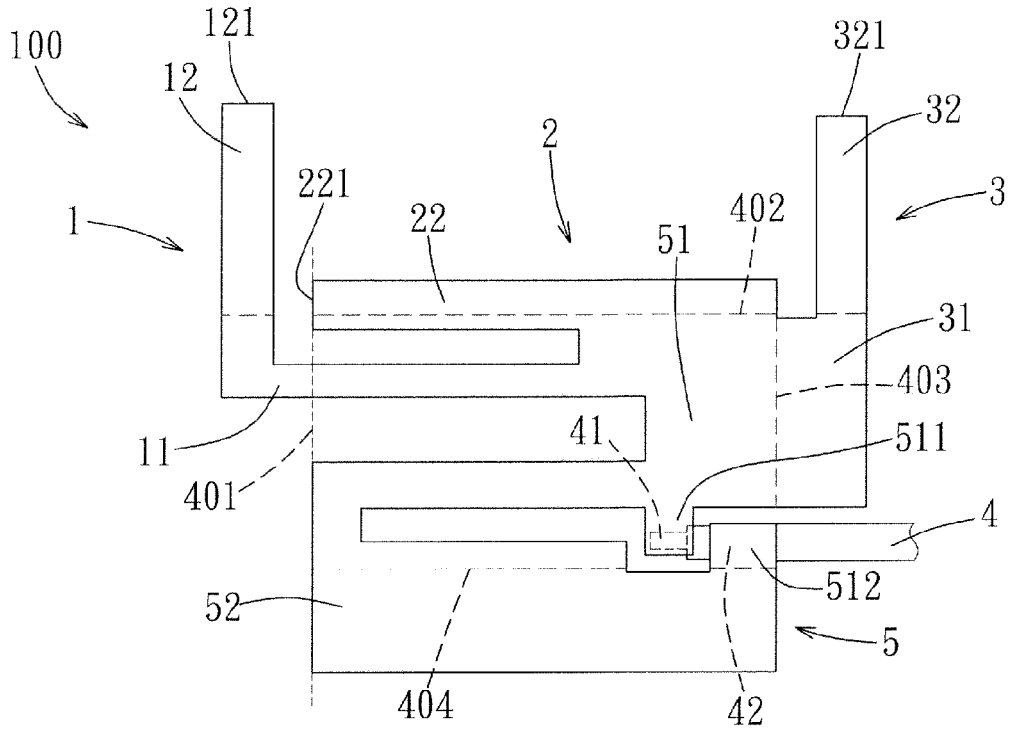
FIG. 2 is a schematic view, illustrating an unfolded state of the three-dimensional slot antenna.

Referring to FIG. 2, the three-dimensional slot antenna 100 includes a loop conductor 5, a first conductor arm 1, a second conductor arm 2, a third conductor arm 3, and a transmission line 4.

The loop conductor 5 has a first side, a second side opposite to the first side, and a third side extending between the first and second sides. The first conductor arm 1 includes a first radiator section 12 and a first connecting section 11 interconnecting the first radiator section 12 and the first side of the loop conductor 5. The second conductor arm 2 includes a second radiator section 22 connected to the third side of the loop conductor 5. The third conductor arm 3 includes a third radiator section 32 and a third connecting section 31 interconnecting the third radiator section 32 and the second side of the loop conductor 5. The transmission line 4 has a signal terminal 41 and a grounding terminal 42. The loop conductor 5 further includes a feed-in part 511 connected to the signal terminal 41, and a grounding part 512 connected to the grounding terminal 42. Moreover, the loop conductor 5, the first conductor arm 1, the second conductor arm 2, and the third conductor arm 3 are formed integrally.

Figure 6:
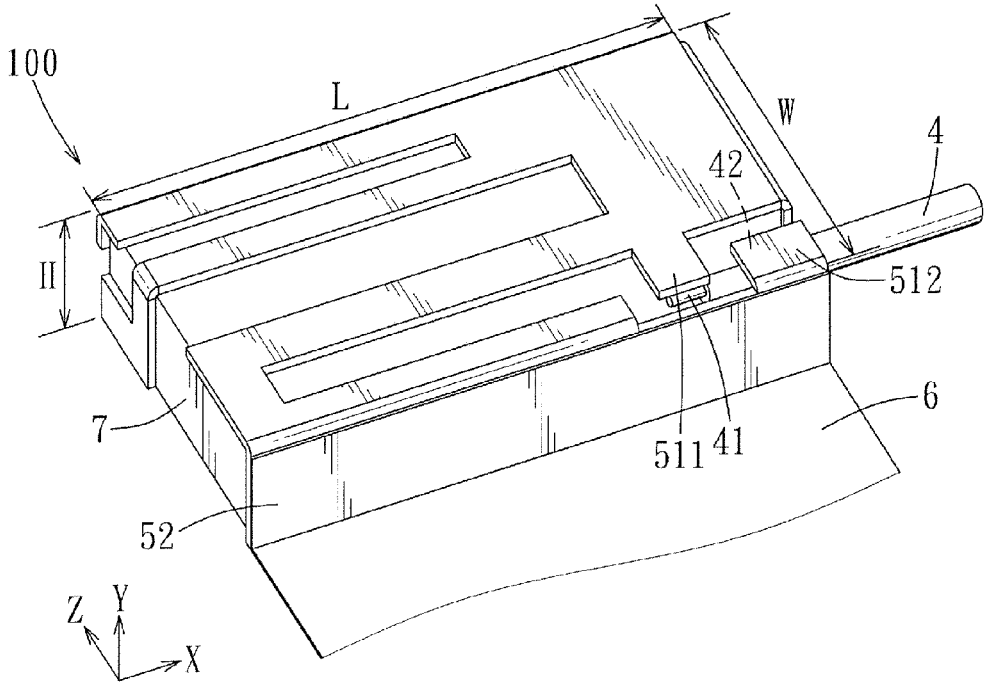
FIG. 6 is a perspective view to illustrate that the three-dimensional slot antenna as shown in FIG. 2 is bent along a plurality of fold lines to form a substantially box-shaped structure in which a support member is disposed.
Figure 7:
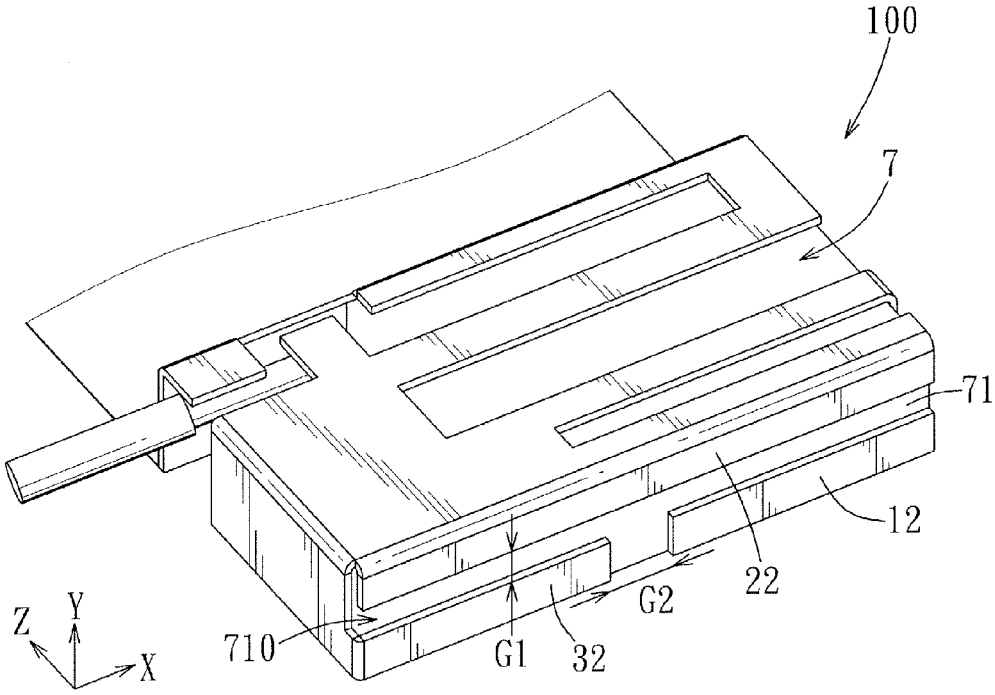
FIG. 7 is a perspective view similar to FIG. 6, but viewed from a different angle.

Referring to FIG. 6 and FIG. 7, the three-dimensional slot antenna 100 is bent along a plurality of fold lines as shown in FIG. 2 to form a three-dimensional structure. The first conductor arm 1 is bent from the loop conductor 5 along a first fold line 401. The second radiator section 22 is bent from the loop conductor 5 along a second fold line 402. The third conductor arm 3 is bent from the loop conductor 5 along a third fold line 403. The loop conductor 5 includes a first conductor part 51 to which the first, second and third conductor arms 1, 2, 3 are connected, and a second conductor part 52 bent from the first conductor part 51 along a fourth fold line 404. Thus the first, second, and third conductor arms 1, 2, 3 and the loop conductor 5 cooperate to form a substantially box-shaped structure. The second conductor part 52 of the loop conductor 5 is connected to a conductive foil 6, which is to be connected electronically to a ground plane of the display screen 301 of the notebook computer 300 as shown in FIG. 1.

The three-dimensional slot antenna 100 further includes a support member 7 disposed in the box-shaped structure. The first radiator section 12, the second radiator section 22 and the third radiator section 32 are disposed on a same plane at a surface 71 of the support member 7. The second radiator section 22 cooperates with the first and third radiator sections 12, 32 to form a first slot segment, i.e., a first clearance (G1) is formed between the second radiator section 22 and each of the first and third radiator section 12, 32. The first radiator section 12 further cooperates with the third radiator section 32 to form a second slot segment, i.e., a second clearance (G2) is further formed between the first and third radiator section 12, 32. The first and second slot segments form a substantially T-shaped slot 710. The three-dimensional slot antenna 100 of the present invention is characterized in that, by adjusting dimensions of the substantially T-shaped slot 710, the loop conductor 5, the first conductor arm 1, the second conductor arm 2, and the third conductor 3 may cooperate to achieve an effect of multi-band operation.

In this embodiment, the substantially box-shaped structure has dimensions of a length L=17 mm, a width W=10 mm, and a height H=4 mm. The substantially T-shaped slot 710 has dimensions of the first clearance (G1)=2.5 mm and the second clearance (G2)=2.5 mm.

Figure 3:
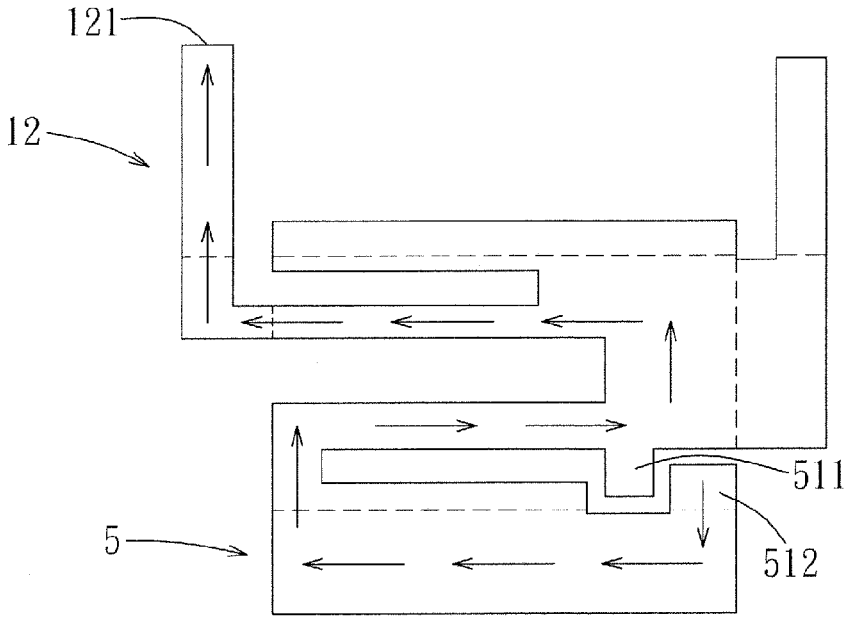
FIG. 3 is a schematic view, illustrating a first current path, formed by a loop conductor and a first conductor arm of the three-dimensional slot antenna, when the slot antenna resonates in a first operational frequency band.

Referring to FIG. 3, the first radiator section 12 has a first radiator end 121 opposite to the first connecting section 11. The loop conductor 5 and the first conductor arm 1 may resonate in a first operational frequency band, that is, a first current path from the grounding part 512 passing through the feed-in part 511 to the first radiator end 121, for resonating in Wireless Local Area Network (WLAN) 802.11b/g frequency band ranging from 2412 MHz to 2462 MHz, and World Interoperability for Microwave Access (WiMAX) frequency band ranging from 2300 MHz to 2700 MHz. Furthermore, impedance bandwidth may be changed by adjusting dimensions (e.g., length) of the first conductor arm 1.

Figure 4:
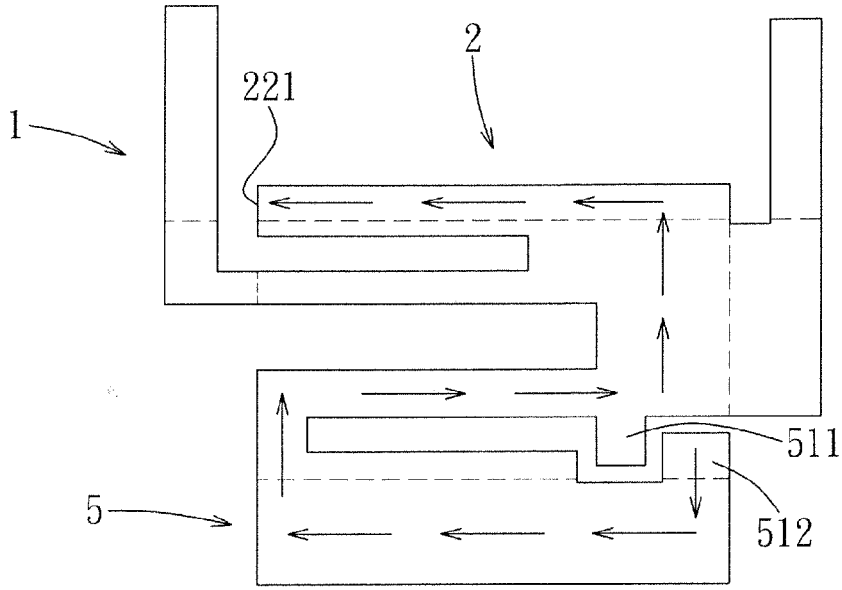
FIG. 4 is a schematic view, illustrating a second current path, formed by the loop conductor and a second conductor arm of the three-dimensional slot antenna, when the slot antenna resonates in a second operational frequency band.

Referring to FIG. 4, the second radiator section 22 has a second radiator end 221 adjacent to the first conductor arm 1. The loop conductor 5 and the second conductor arm 2 may resonate in a second operational frequency band, that is, a second current path from the grounding part 512 passing through the feed-in part 511 to the second radiator end 221, for resonating in WiMAX frequency band ranging from 3300 MHz to 3800 MHz. Furthermore, impedance bandwidth may be changed by adjusting dimensions (e.g., length) of the second conductor arm 2.

Figure 5:
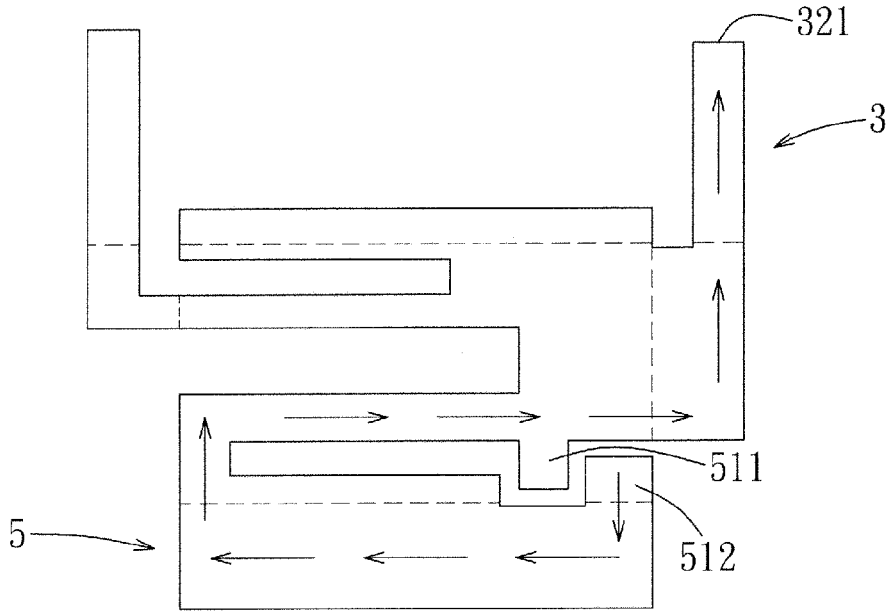
FIG. 5 is a schematic view, illustrating a third current path, formed by the loop conductor and a third conductor arm of the three-dimensional slot antenna, when the antenna resonates in a third operational frequency band.

Referring to FIG. 5, the third radiator section 32 has a third radiator end 321 opposite to the third connecting section 31. The loop conductor 5 and the third conductor arm 3 may resonate in a third operational frequency band, that is, a third current path from the grounding part 512 passing through the feed-in part 511 to the third radiator end 321, for resonating in WLAN 802.11a frequency band ranging from 5150 MHz to 5875 MHz. Furthermore, impedance bandwidth may be changed by adjusting dimensions (e.g., length) of the third conductor arm 3 and the loop conductor 5.

Figure 8:
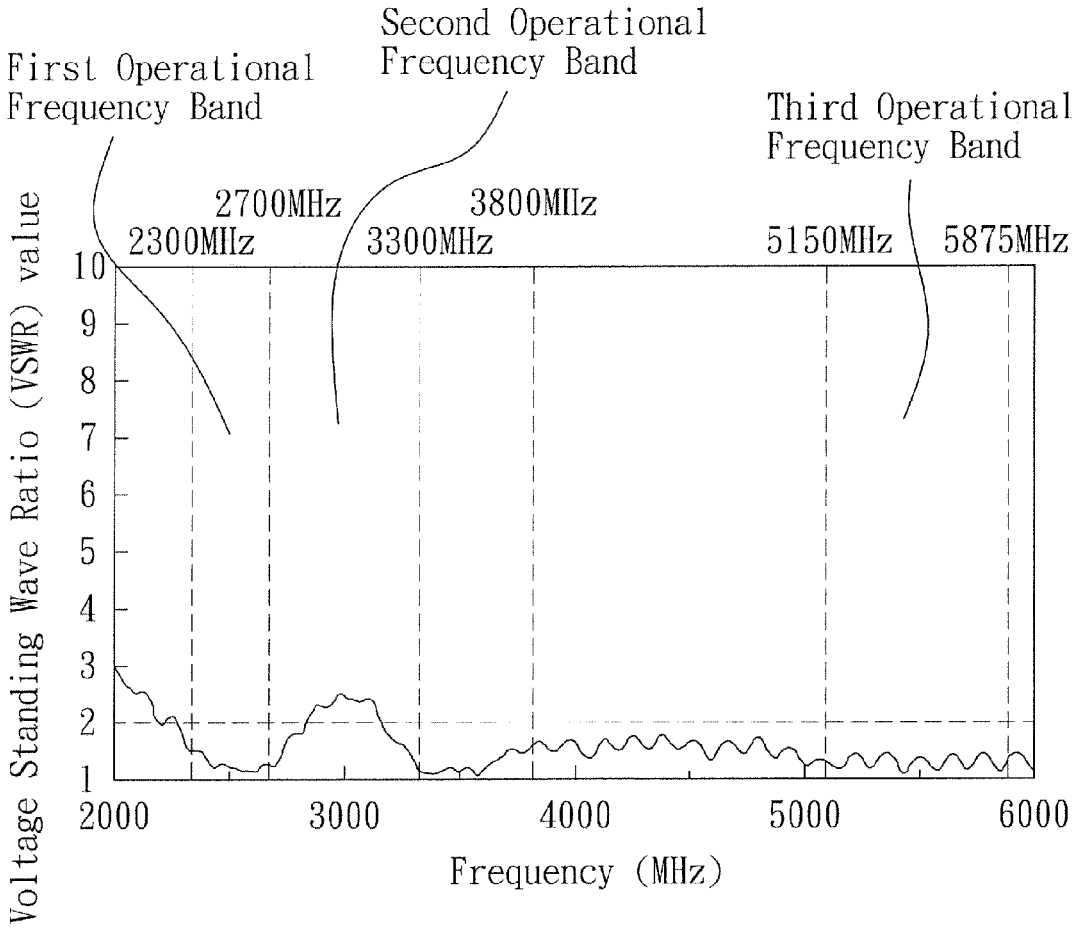
FIG. 8 is a Voltage Standing Wave Ratio (VSWR) plot of the preferred embodiment.
Figure 9:
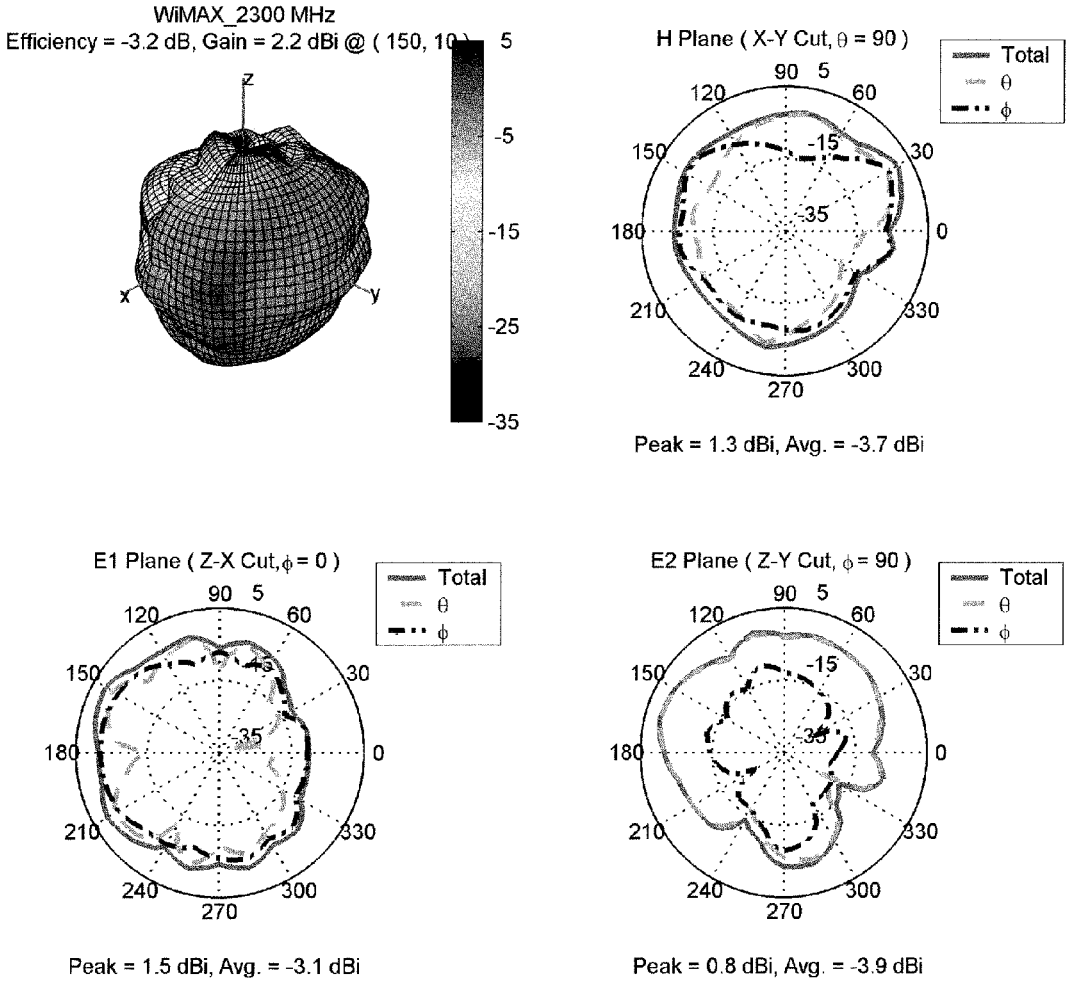
FIG. 9 illustrates radiation patterns of the three-dimensional slot antenna operating at 2300 MHz.
Figure 10:
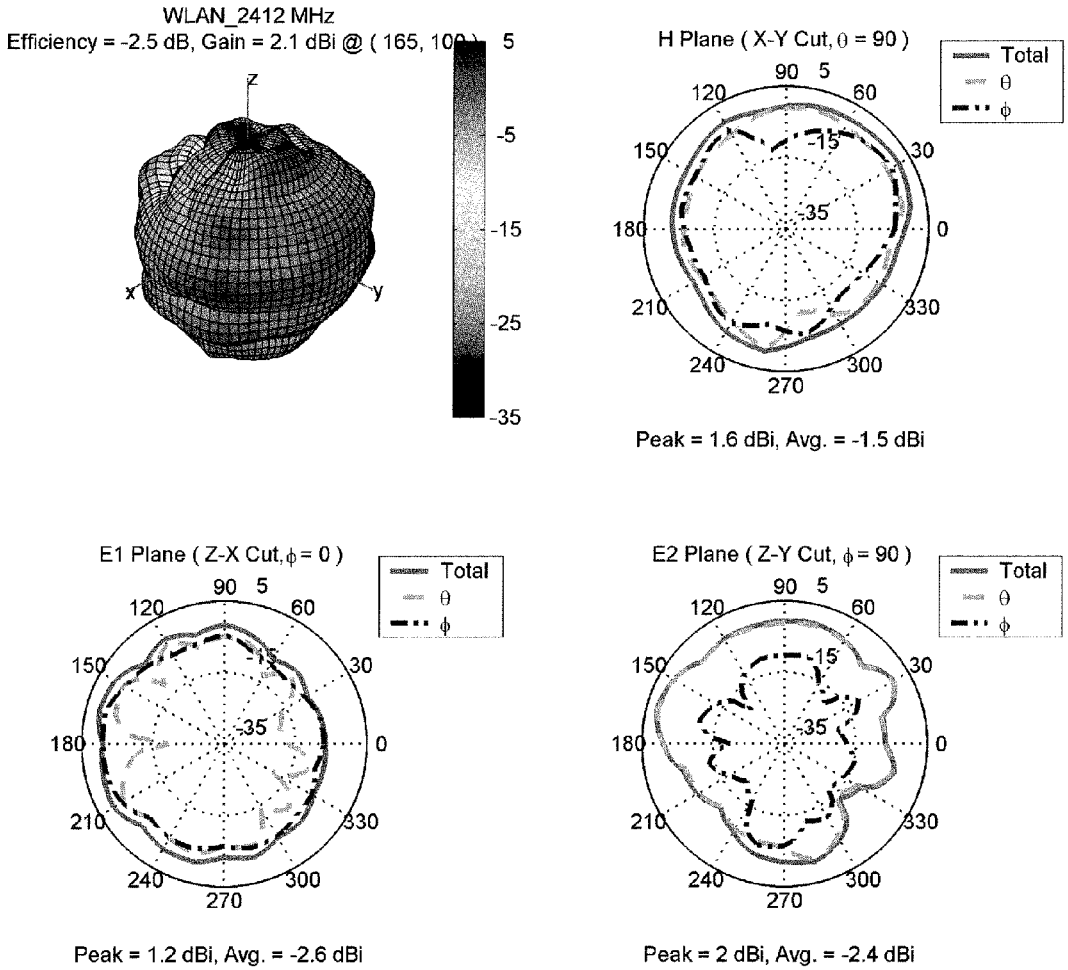
FIG. 10 illustrates radiation patterns of the three-dimensional slot antenna operating at 2412 MHz.
Figure 11:
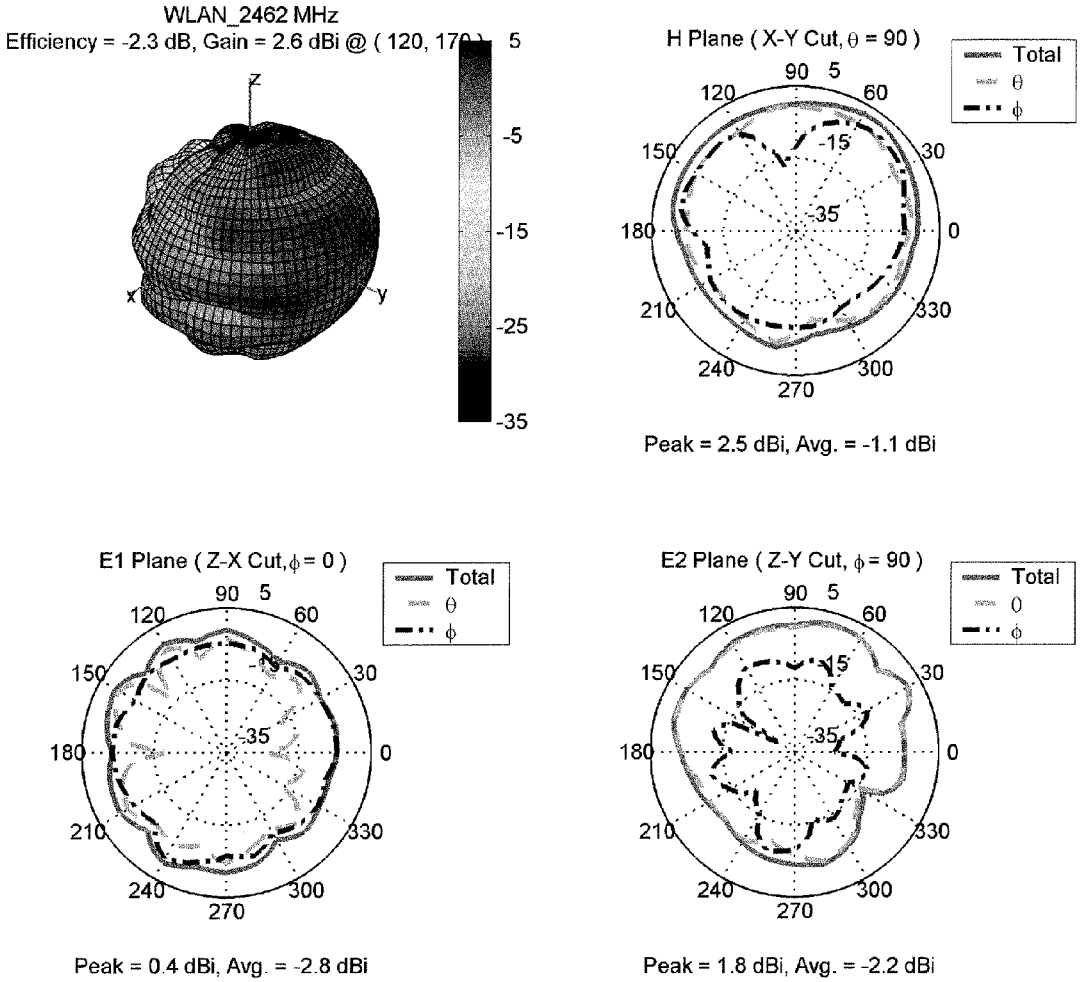
FIG. 11 illustrates radiation patterns of the three-dimensional slot antenna operating at 2462 MHz.
Figure 12:
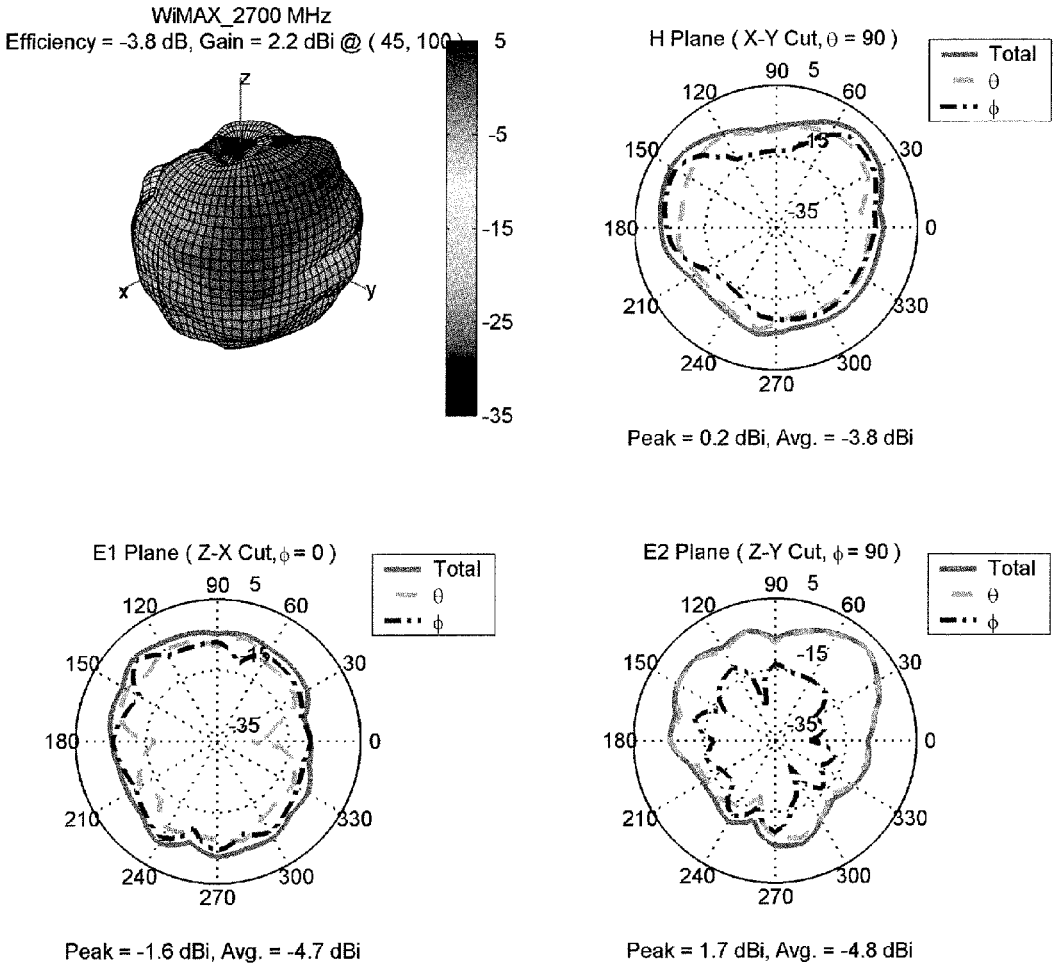
FIG. 12 illustrates radiation patterns of the three-dimensional slot antenna operating at 2700 MHz.
Figure 13:
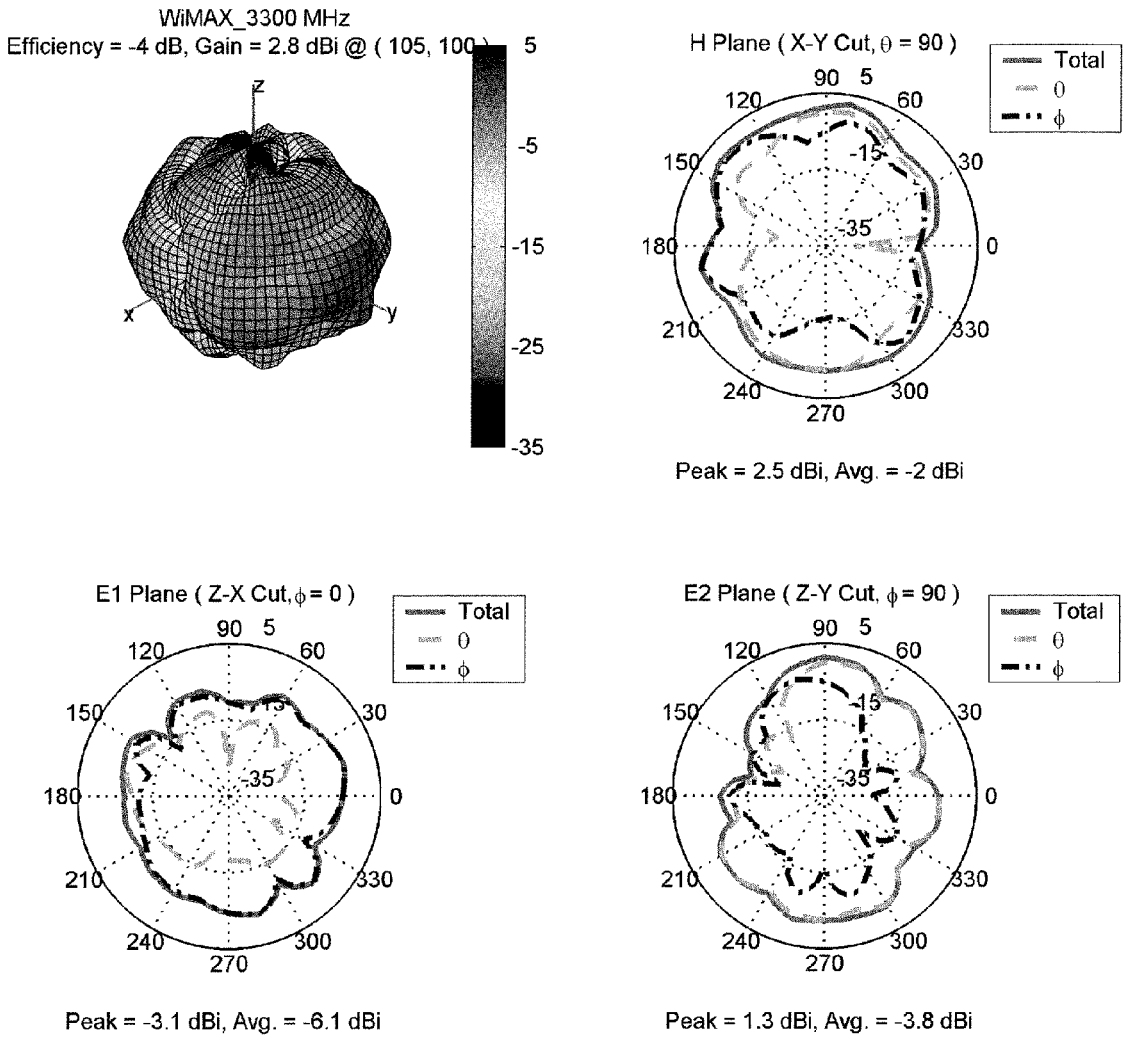
FIG. 13 illustrates radiation patterns of the three-dimensional slot antenna operating at 3300 MHz.
Figure 14:
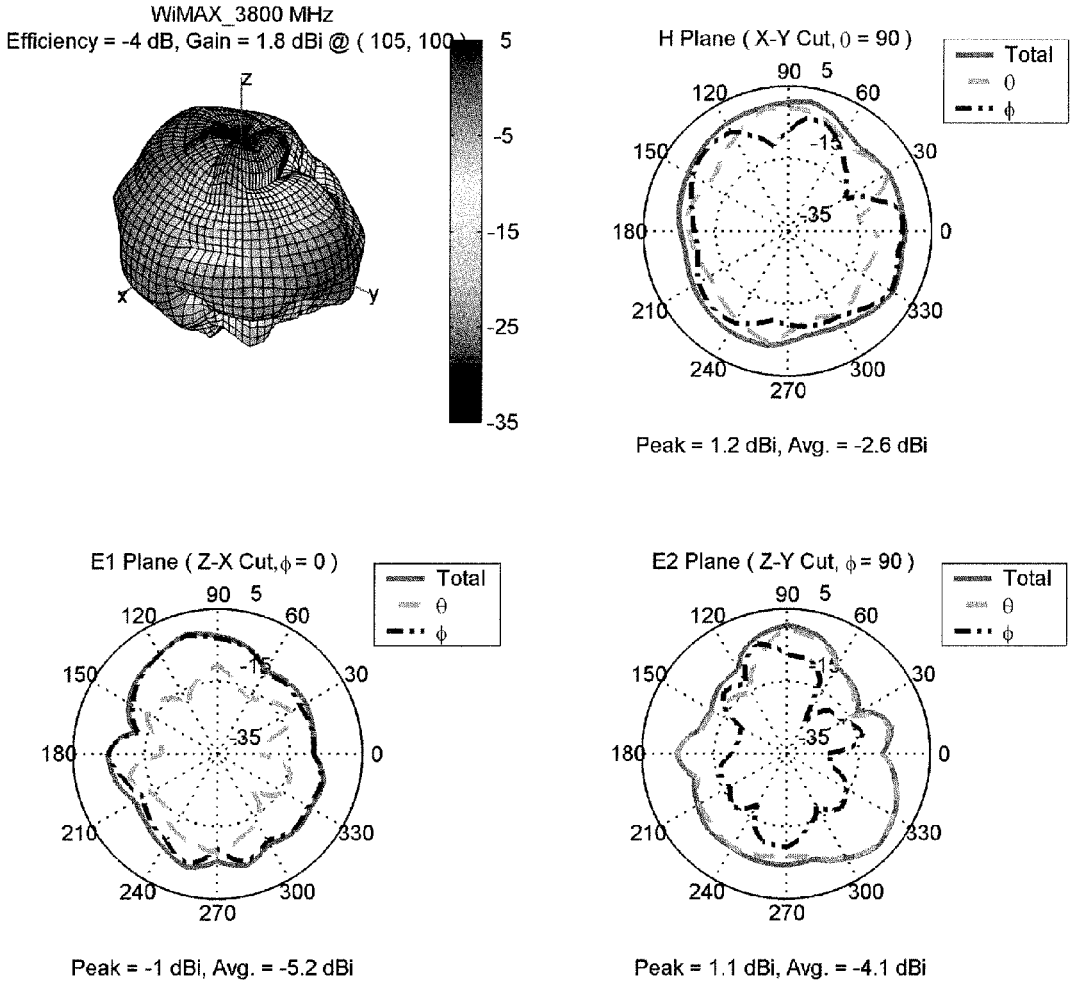
FIG. 14 illustrates radiation patterns of the three-dimensional slot antenna operating at 3800 MHz.
Figure 15:
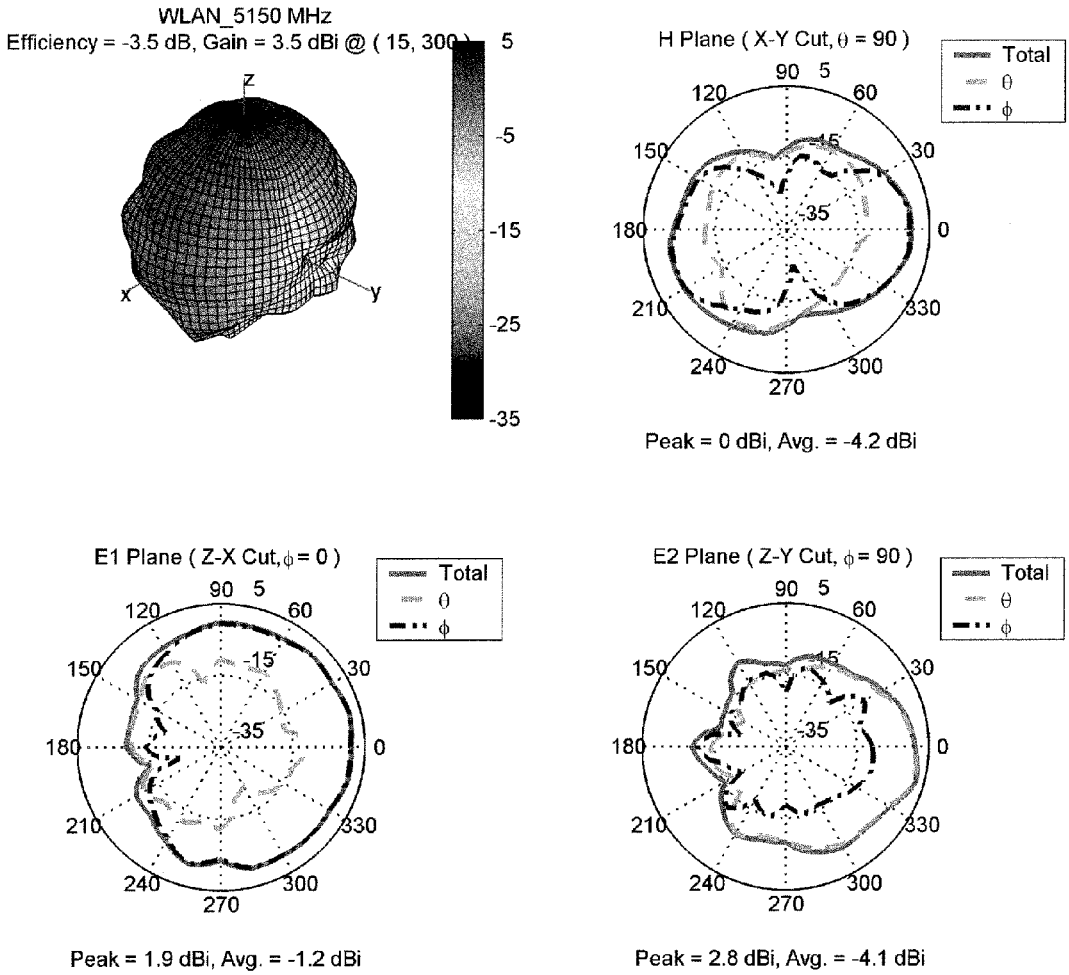
FIG. 15 illustrates radiation patterns of the three-dimensional slot antenna operating at 5150 MHz.
Figure 16:
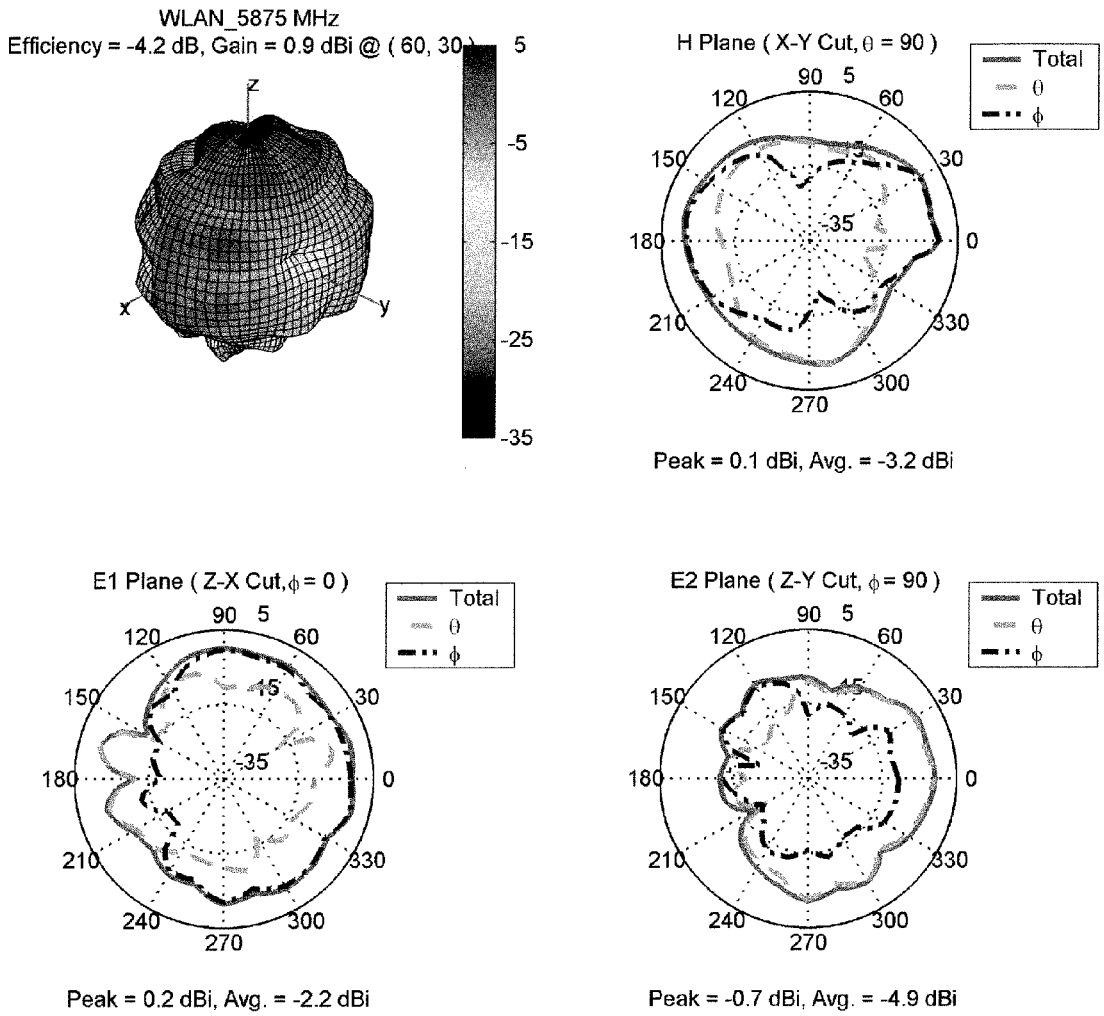
FIG. 16 illustrates radiation patterns of the three-dimensional slot antenna operating at 5875 MHz.

Referring to FIG. 8, a Voltage Standing Wave Ratio (VSWR) plot of the three-dimensional slot antenna 100 is illustrated. It is apparent from the plot that VSWR values corresponding to the first operational frequency band ranging from 2300 MHz to 2700 MHz, the second operational frequency band ranging from 3300 MHz to 3800 MHz, and the third operational frequency band ranging from 5150 MHz to 5875 MHz are all less than 2. Moreover, referring to Table 1, radiation efficiency at the operational frequency bands is greater than −4.4 dB, i.e., 36.3%.

TABLE 1

| Frequency(MHz) | Efficiency(dB) | Efficiency (%) |
|---|---|---|
| 2300 | −3.2 | 47.9 |
| 2412 | −2.5 | 56.2 |
| 2437 | −2.5 | 56.2 |
| 2462 | −2.3 | 58.9 |
| 2500 | −3.0 | 50.1 |
| 2600 | −3.4 | 45.7 |
| 2700 | −3.8 | 41.7 |
| 3300 | −4.0 | 39.8 |
| 3400 | −3.6 | 43.7 |
| 3500 | −3.8 | 41.7 |
| 3600 | −4.3 | 37.2 |
| 3700 | −3.6 | 43.7 |
| 3800 | −4.0 | 39.8 |
| 5150 | −3.5 | 44.7 |
| 5350 | −3.7 | 42.7 |
| 5470 | −4.0 | 39.8 |
| 5725 | −4.4 | 36.3 |
| 5875 | −4.2 | 38.0 |

Referring to FIG. 9 to FIG. 16, radiation patterns of the three-dimensional slot antenna 100 and in X-Y Plane, Z-X Plane, and Z-Y Plane at frequencies of 2300 MHz, 2412 MHz, 2462 MHz, 2700 MHz, 3300 MHz, 3800 MHz, 5150 MHz, and 5875 MHz are illustrated. The radiation patterns exhibit substantially omni-directional characteristics that satisfy operating requirements for WLAN and WiMAX.

In summary, the three-dimensional slot antenna 100 of the present invention has advantages including:

1. the three-dimensional slot antenna 100 is formed with the substantially T-shaped slot 710, dimensions of the first clearance (G1) and the second clearance (G2) of which may be adjusted for multi-band operation;
2. the three-dimensional slot antenna 100 being formed integrally to facilitate manufacture and assembly; and
3. the three-dimensional slot antenna 100 being capable of operating in three frequency bands covering WLAN and WiMAX frequency bands, in other words, the three-dimensional slot antenna 100 being applicable to frequency bands of different wireless communication specifications to save cost and space.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A three-dimensional slot antenna comprising:

a loop conductor having a first side, a second side opposite to said first side, and a third side extending between said first and second sides;

a first conductor arm including a first radiator section and a first connecting section interconnecting said first radiator section and said first side of said loop conductor;

a second conductor arm including a second radiator section connected to said third side of said loop conductor; and a third conductor arm including a third radiator section and a third connecting section interconnecting said third radiator section and said second side of said loop conductor;

wherein said first radiator section, said second radiator section and said third radiator section are disposed on a same plane, said second radiator section cooperating with said first and third radiator sections to form a first slot segment, said first radiator section further cooperating with said third radiator section to form a second slot segment, said first and second slot segments forming a substantially T-shaped slot.

2. The three-dimensional slot antenna as claimed in claim 1, wherein said loop conductor, said first conductor arm, said second conductor arm, and said third conductor arm are formed integrally.

3. The three-dimensional slot antenna as claimed in claim 2, wherein:

said first conductor arm is bent from said loop conductor along a first fold line, said second radiator section is bent from said loop conductor along a second fold line, said third conductor arm is bent from said loop conductor along a third fold line, said loop conductor includes a first conductor part to which said first, second and third conductor arms are connected, and a second conductor part bent from said first conductor part along a fourth fold line, said first, second, and third conductor arms and said loop conductor cooperating to form a substantially box-shaped structure.

4. The three-dimensional slot antenna as claimed in claim 3, further comprising a support member disposed in said box-shaped structure, said first radiator section, said second radiator section and said third radiator section being disposed on a same surface of said support member.

5. The three-dimensional slot antenna as claimed in claim 4, further comprising a transmission line having a signal terminal and a grounding terminal, said loop conductor further including a feed-in part connected to said first conductor part and said signal terminal, and a grounding part connected to said second conductor part and said grounding terminal.

6. The three-dimensional slot antenna as claimed in claim 1, further comprising a transmission line having a signal terminal and a grounding terminal, said loop conductor further including a feed-in part connected to said signal terminal, and a grounding part connected to said grounding terminal.

7. The three-dimensional slot antenna as claimed in claim 6, which is operable to resonate in Wireless Local Area Network (WLAN) and World Interoperability for Microwave Access (WiMAX) frequency bands.

8. The three-dimensional slot antenna as claimed in claim 1, which is operable to resonate in WLAN and WiMAX frequency bands.

9. The three-dimensional slot antenna as claimed in claim 2, which is operable to resonate in WLAN and WiMAX frequency bands.

10. The three-dimensional slot antenna as claimed in claim 3, which is operable to resonate in WLAN and WiMAX frequency bands.

11. The three-dimensional slot antenna as claimed in claim 4, which is operable to resonate in WLAN and WiMAX frequency bands.

12. The three-dimensional slot antenna as claimed in claim 5, which is operable to resonate in WLAN and WiMAX frequency bands.

* * * * *